US009045924B2

(12) United States Patent
Aragon et al.

(10) Patent No.: US 9,045,924 B2
(45) Date of Patent: Jun. 2, 2015

(54) BREAKAWAY LOADING DOCK DOOR SYSTEM

(71) Applicant: Cold Chain, LLC, Boise, ID (US)

(72) Inventors: Daniel M. Aragon, Meridian, ID (US); Peter James Wachtell, Boise, ID (US); Todd J. Lindsey, Boise, ID (US); John J. Prehn, Boise, ID (US)

(73) Assignee: COLD CHAIN, LLC, Boise, ID (US)

( * ) Notice: Subject to any disclaimer, the term of this patent is extended or adjusted under 35 U.S.C. 154(b) by 0 days.

(21) Appl. No.: 14/539,730

(22) Filed: Nov. 12, 2014

(65) Prior Publication Data

US 2015/0075077 A1 Mar. 19, 2015

Related U.S. Application Data

(63) Continuation-in-part of application No. 14/041,470, filed on Sep. 30, 2013, now Pat. No. 8,887,442.

(60) Provisional application No. 61/709,401, filed on Oct. 4, 2012.

(51) Int. Cl.

| | |
|---|---|
| ***E05B 65/10*** | (2006.01) |
| ***E05D 15/16*** | (2006.01) |
| ***E05D 15/00*** | (2006.01) |
| ***E06B 3/42*** | (2006.01) |
| ***E05D 15/48*** | (2006.01) |
| ***E06B 1/52*** | (2006.01) |
| ***E06B 1/56*** | (2006.01) |

(52) U.S. Cl.

CPC ..... *E05D 15/165* (2013.01); *E05D 15/00* (2013.01); *E06B 3/42* (2013.01); *E05D 15/48* (2013.01); *E06B 1/522* (2013.01); *E06B 1/56* (2013.01); *E05Y 2800/102* (2013.01); *E05Y 2900/11* (2013.01); *E05Y 2201/688* (2013.01); *E05Y 2800/744* (2013.01)

(58) Field of Classification Search

USPC ..... 49/141, 197, 198, 506; 160/201, 205, 160/282, 285, 284, 287

See application file for complete search history.

(56) References Cited

U.S. PATENT DOCUMENTS

| | | | | |
|---|---|---|---|---|
| 5,535,805 | A | 7/1996 | Kellogg et al. | |
| 5,927,368 | A | 7/1999 | Rohrer et al. | |
| 6,112,799 | A | 9/2000 | Mullett et al. | |
| 6,119,307 | A | 9/2000 | Weishar et al. | |
| 6,125,506 | A | 10/2000 | Martin | |
| 6,273,175 | B1 * | 8/2001 | Kellogg et al. | 160/205 |
| 7,757,437 | B2 | 7/2010 | Schulte et al. | |
| 7,784,520 | B2 | 8/2010 | Paulson | |
| 2001/0027847 | A1 | 10/2001 | Horner et al. | |
| 2002/0179254 | A1 | 12/2002 | Schulte | |
| 2003/0178159 | A1 | 9/2003 | David | |
| 2011/0088327 | A1 | 4/2011 | Meichtry | |
| 2014/0096451 | A1 | 4/2014 | Aragon et al. | |

OTHER PUBLICATIONS

Jin Ho Kim (Authorized Officer), International Search Report and Written Opinion dated Jul. 17, 2014, PCT Application No. PCT/US2013/063445, filed Oct. 4, 2013, pp. 1-14.

* cited by examiner

*Primary Examiner* — Gregory Strimbu

(74) *Attorney, Agent, or Firm* — MH2 Technology Law Group, LLP

(57) ABSTRACT

A system for allowing a loading dock door to release from a track upon being struck by a fork lift or other sufficiently strong force. The system employs a unique track profile with one or more sidewalls that have an angled sidewall profile to allow a release assembly to move out of the track. The release assembly includes a biasing mechanism that allows the assembly to flex and ride out of the track when the door is impacted.

20 Claims, 10 Drawing Sheets

BREAKAWAY LOADING DOCK DOOR SYSTEM

RELATED APPLICATION

This application is a continuation-in-part of U.S. application Ser. No. 14/041,470, filed Sep. 30, 2013, now U.S. Pat. No. 8,887,442 which claims benefit to U.S. Provisional Application No. 61/709,401, filed Oct. 4, 2012, the disclosures of both of which applications are incorporated herein by reference in their entirety.

DETAILED DESCRIPTION

Field of the Disclosure

This disclosure relates generally to the field of dock doors and more specifically to a system for allowing a loading dock door to be mounted and used with the functionality such that, upon being struck by a fork lift or other strong force it releases itself from its tracks.

Background

Warehouse operations generally have several door openings from which truck or rail cargos may be easily loaded and unloaded. These door openings are generally covered when not in use by doors that are specifically designed to be used as loading dock doors. The typical loading dock door has aspects of its design that make it suitable for loading dock operations, such as some ability to be locked and to provide security for the premises, a window through which to see if a truck or train is backed into the loading dock area, a wheel and track system that allows the door to be opened, either by lifting or rolling up in a vertical fashion, so that when opened it is out of the way of any traffic that results from the loading process.

Loading dock doors often sustain damage as large and heavy loads are moved at frequent high speeds by forklift operators through and around the openings on loading docks. A door that has been struck may be damaged and may, in some cases, not be easily or smoothly opened until it has been repaired and/or adjusted to work properly.

To address these issues, most loading dock doors have been designed to withstand a significant amount of abuse. Doors can be built to withstand greater amounts of abuse by using heavier gauge metals and/or braces for reinforcement to withstand greater strikes from forklifts. As these doors are built to be stronger, they also become heavier and more costly.

In some cases, the doors are designed to be able to release themselves from their tracks via a pivot system that has been built into the wheel and axle assemblies. Door systems that are designed to break away from their tracks have involved the creation of designed pivot points on the wheel assemblies or wheel axles. These break-away points allow the door to break away from the tracks and to be remounted with relative ease and a minimum amount of door damage. Unfortunately, the wheel assemblies are complicated, expensive and prone to breakage with continued use.

SUMMARY

Embodiments of the present disclosure may provide one or more of the following advantages: allowing a door to self-release from its tracks when struck by a fork lift or other relatively large force; reducing damage to a door that has been struck; or allowing the door to be quickly and/or easily reset into its tracks for continued use after self-release.

An embodiment of the present disclosure is directed to a dock door system. The dock door system comprises: a track comprising one or more sidewalls that are angled to allow a wheel to move up the sidewall and out of the tracks; and a door comprising a wheel-and-axle assembly. The wheel-and-axle assembly is configured to allow the wheel to move relative to the door. The wheel is biased in a position on the axle by a biasing mechanism so as to ride in the track. The wheel and axle assembly is configured to allow the wheel to ride up the sidewall and out of the track if the door is struck with sufficient force.

Another embodiment of the present disclosure is directed to a dock door hardware system. The dock door hardware system comprises: a track comprising one or more sidewalls that are angled to allow a wheel to move up the sidewall and out of the tracks; and a wheel-and-axle assembly. The wheel-and-axle assembly comprises an axle, an axle bracket attachable to a dock door and having a receptacle for receiving the axle, a wheel positioned on the axle, and a biasing mechanism for applying a force tending to force the wheel away from the axle bracket. The receptacle and axle are configured so as to allow the axle to move back and forth in the receptacle relative to the bracket. The wheel and axle assembly is configured so that the wheel can ride in the track.

Yet another embodiment of the present disclosure is directed to a dock door wheel-and-axle assembly. The wheel-and-axle assembly comprises: an axle; an axle bracket attachable to a dock door and having a receptacle for receiving the axle; a wheel positioned on the axle; and a biasing mechanism for applying a force tending to force the wheel away from the axle bracket. The receptacle and axle are configured so as to allow the axle to move back and forth in the receptacle relative to the bracket.

Still another embodiment of the present disclosure is directed to a dock door system. The dock door system comprises a first track and a second track. The first track comprises (i) a first sidewall comprising a first substantially planar region, (ii) a second sidewall comprising a second substantially planar region and (iii) a third sidewall comprising a third substantially planar region. The third sidewall is positioned between the first sidewall and the second sidewall. The first substantially planar region, the third substantially planar region and the second substantially planar region are consecutive planar regions. A first angle is defined by the first and third substantially planar regions and a second angle being defined by the second and third substantially planar regions. The first angle ranges from about 100° to about 160°. The dock door system also comprises a dock door comprising a first plurality of release assemblies and a second plurality of release assemblies. Each of the first plurality of release assemblies comprise a puck and a biasing mechanism. Each of the pucks is positioned by a respective one of the biasing mechanisms so as to ride in the first track. The first plurality of release assemblies is configured to allow the pucks to move toward the dock door and out of the first track if the door is struck with sufficient force in a direction that pushes the pucks against the first sidewall. Each of the pucks has a first major surface and a second major surface. A beveled edge extends from the first major surface to the second major surface and is configured to be proximate to the first sidewall when the puck is positioned in the first track. A second edge extends from the first major surface to the second major surface and is configured to be proximate to the second sidewall when the puck is positioned in the first track.

Another embodiment of the present disclosure is directed to a dock door hardware system. The system comprises a track comprising (i) a first sidewall comprising a first substantially planar region, (ii) a second sidewall comprising a second substantially planar region and (iii) a third sidewall comprising a third substantially planar region. The third sidewall is positioned between the first sidewall and the second sidewall. The first substantially planar region, the third substantially planar region and the second substantially planar region are consecutive planar regions. A first angle is defined by the first and third substantially planar regions and a second angle is defined by the second and third substantially planar regions. The first angle ranges from about 100° to about 160°. The system further comprises a release assembly comprising an axle, an axle bracket attachable to a dock door and having a receptacle for receiving the axle, a puck positioned on the axle, and a biasing mechanism configured for applying a force tending to force the puck away from the axle bracket and toward the track so as to ride in the track. The receptacle and axle are configured so as to allow the axle to move back and forth in the receptacle relative to the bracket. The release assembly is configured so that the puck can move out of the track if a sufficient force is applied to the release assembly in a direction that pushes the puck against the first sidewall. The puck has a first major surface and a second major surface. A beveled edge extends from the first major surface to the second major surface and is configured to be proximate to the first sidewall when the puck is positioned in the first track. A second edge extends from the first major surface to the second major surface and is configured to be proximate to the second sidewall when the puck is positioned in the first track.

Another embodiment of the present disclosure is directed to a method of installing a breakaway dock door system. The method comprises installing a first track proximate a dock door opening. The first track comprises (i) a first sidewall comprising a first substantially planar region, (ii) a second sidewall comprising a second substantially planar region and (iii) a third sidewall comprising a third substantially planar region. The third sidewall is positioned between the first sidewall and the second sidewall. The first substantially planar region, the third substantially planar region and the second substantially planar region are consecutive planar regions. A first angle is defined by the first and third substantially planar regions and a second angle is defined by the second and third substantially planar regions. The first angle ranges from about 100° to about 160°. The method also comprises installing a first plurality of release assemblies on a side of a dock door. Each of the first plurality of release assemblies comprises a puck and a biasing mechanism. Each of the pucks is positioned by a respective one of the biasing mechanisms so as to ride in the first track. The first plurality of release assemblies is configured to allow the pucks to move toward the dock door and out of the first track if the door is struck with sufficient force in a direction that pushes the pucks against the first sidewall. Each of the pucks has a first major surface and a second major surface. A beveled edge extends from the first major surface to the second major surface and is configured to be proximate to the first sidewall when the puck is positioned in the first track. A second edge extends from the first major surface to the second major surface and is configured to be proximate to the second sidewall when the puck is positioned in the first track.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrates embodiments of the present teachings and together with the description, serve to explain the principles of the present teachings.

Figure 1:
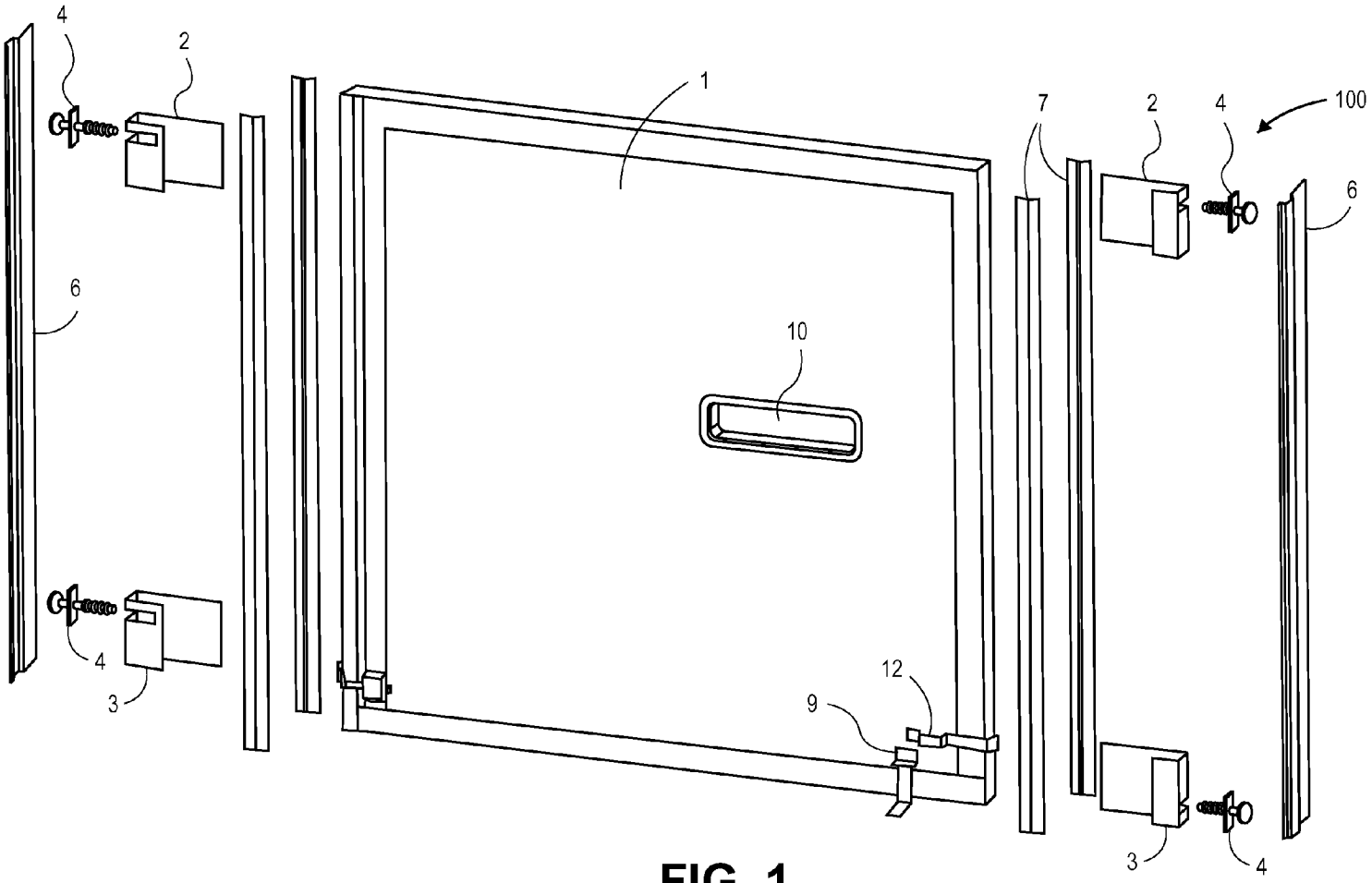
FIG. 1 illustrates a dock door, according to an embodiment of the present disclosure.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. In the drawings, like reference numerals have been used throughout to designate similar elements. In the following description, reference is made to the accompanying drawings that forms a part thereof, and in which is shown by way of illustration a specific exemplary embodiment in which the present teachings may be practiced. The following description is, therefore, merely exemplary.

In accordance with an embodiment of the disclosure, there is disclosed a loading dock door system that is configured so that in the event it is struck by a fork lift or other strong force, it releases itself from its tracks, thereby reducing the risk of substantial damage to the door. The door system comprises a unique track profile with one or more sidewalls that have an angled sidewall profile to allow the wheel assembly to move up the sidewall and out of the tracks. A tensioned or spring loaded wheel assembly biases the door so that it generally stays on the track, while providing enough flex for the door to ride up the sidewall and out of the tracks when struck with sufficient force.

As will be shown in greater detail below, the system comprises a track with an angled sidewall profile combined with wheel assemblies that are spring mounted. The wheel of the wheel assembly can be pushed inward toward the door, allowing the wheel assembly to ride up and out of the track itself, thus releasing the door if it is struck with a force that is large enough to depress the springs in the wheel assembly.

By adjusting the angle of the sidewall in the track and/or the strength of the springs in the assembly, a door can be designed to release easily with relatively modest forces, or to be released only upon relatively large forces striking it. A slight change in the angle of the side wall profile of the track can change the amount of force that is required for a door to be pushed hard enough to be released.

FIG. 1 illustrates a dock door system 100, according to an embodiment of the present disclosure. A dock door 1 includes a plurality of wheel assemblies 4. A track 6 is configured to allow wheels of the wheel assemblies 4 to run in the tracks so that the dock door 1 can be opened and closed, similar to a traditional overhead door. In addition, the track 6 and wheel assemblies 4 are configured so that the wheels can come out of the track 6 when dock door 1 is struck with sufficient force, as will now be described in detail.

Figure 2:
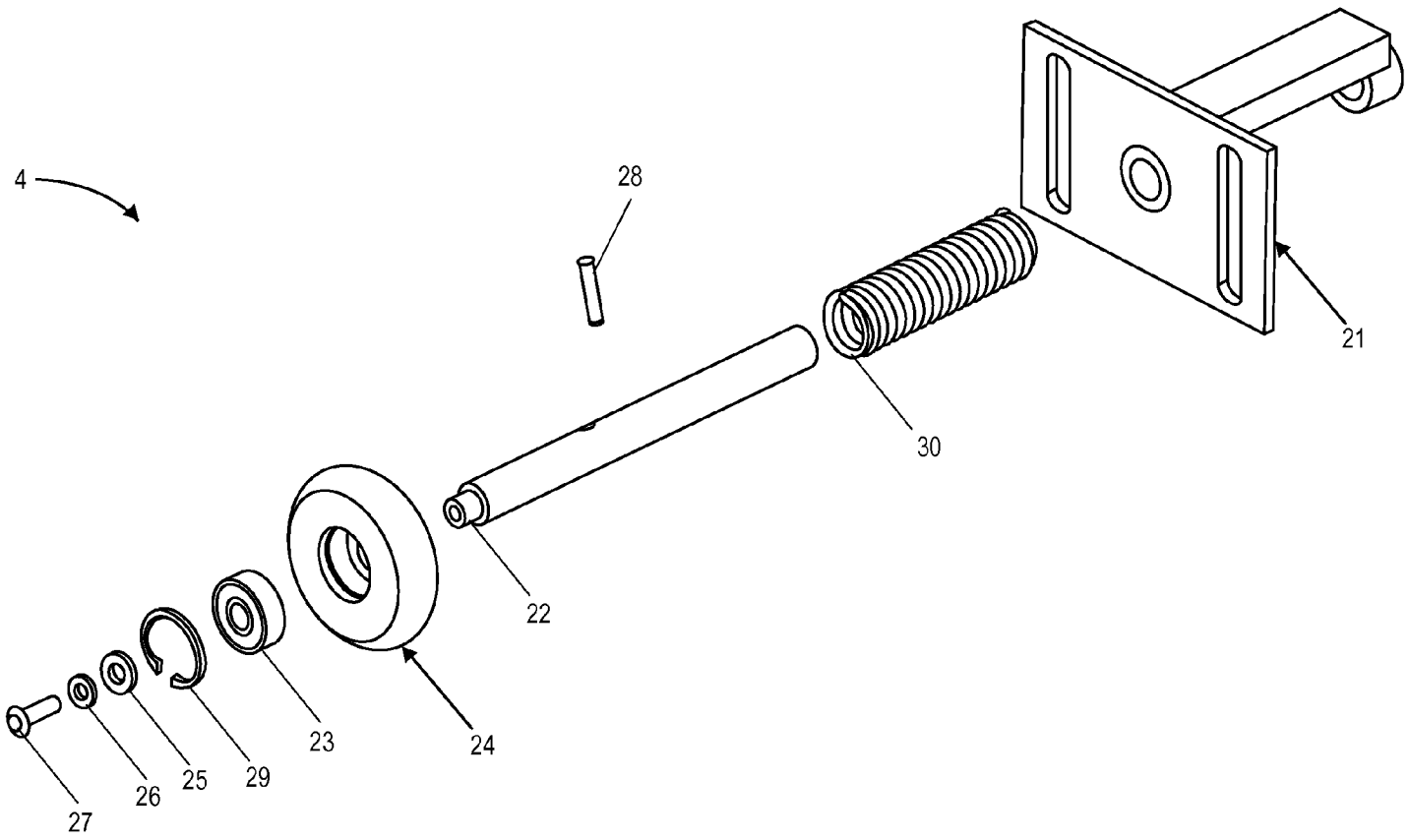
FIG. 2 illustrates an exploded view of a release assembly comprising a wheel, according to an embodiment of the present disclosure.
Figure 3A:
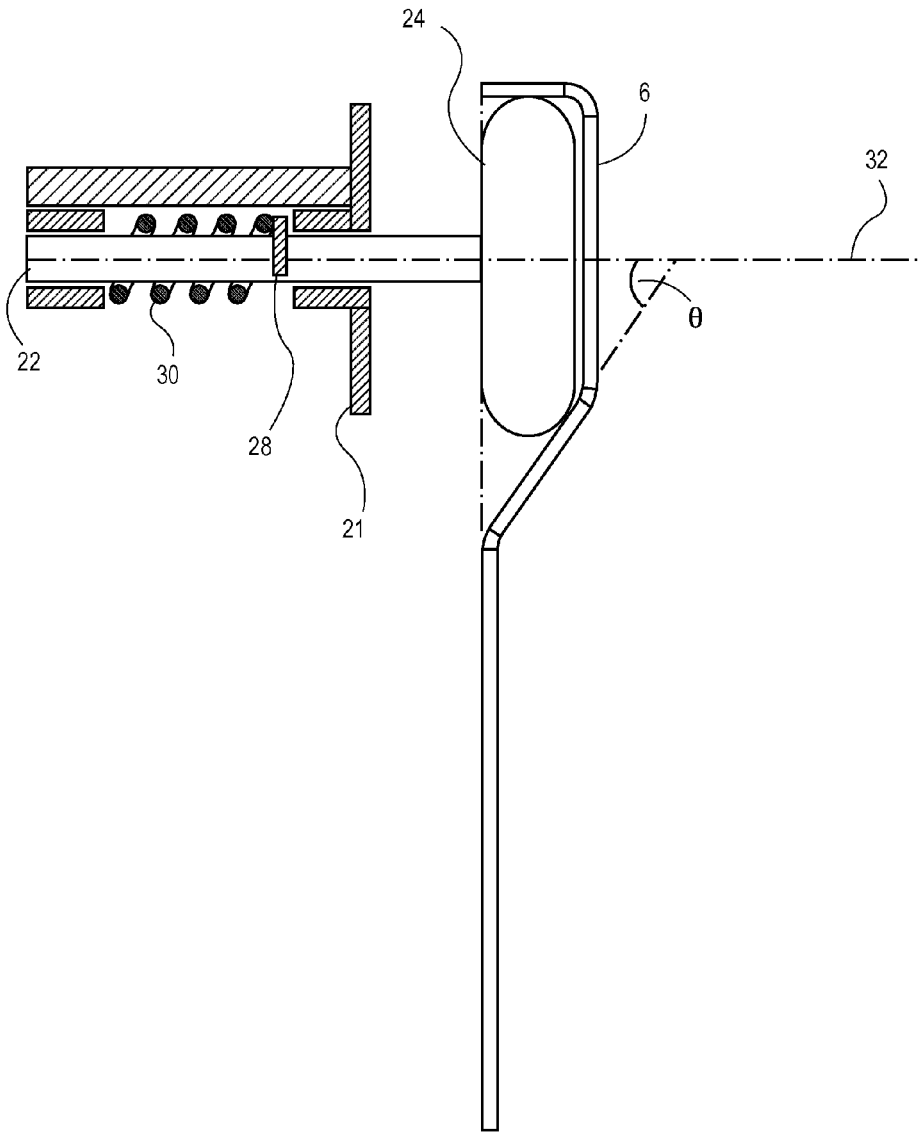
FIG. 3A illustrates a wheel assembly in relation to a dock door and biased in position so as to ride in a track, according to an embodiment of the present disclosure.
Figure 3B:
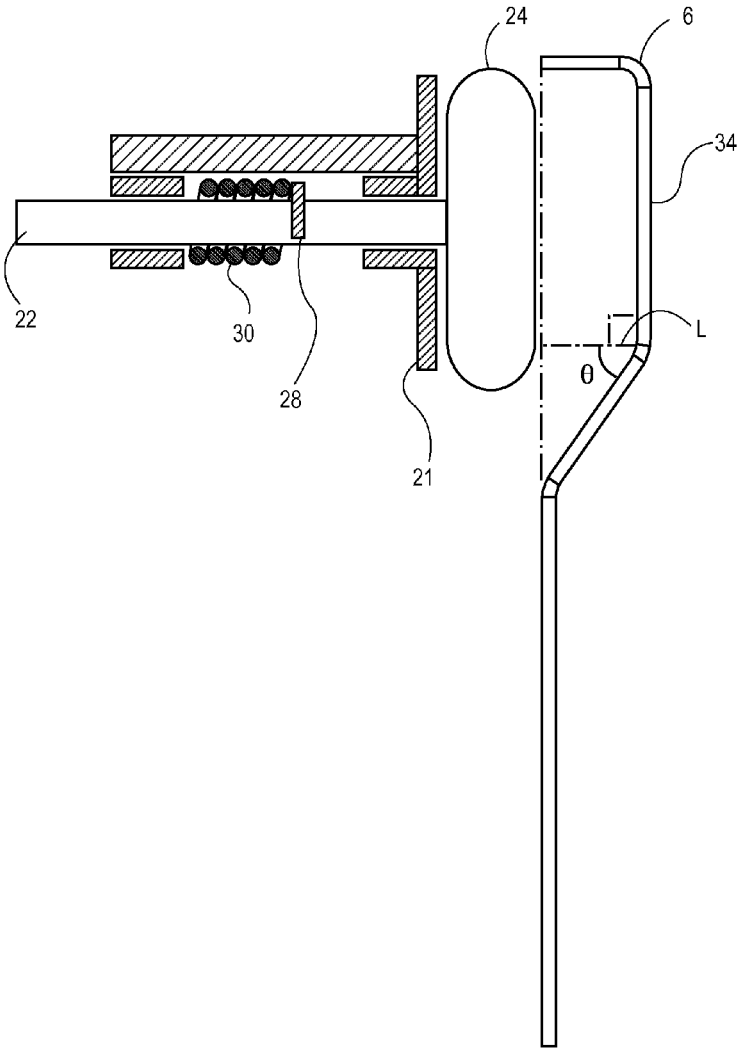
FIG. 3B illustrates a wheel assembly in relation to a dock door and biased in position so as to be out of the track according to an embodiment of the present disclosure.

FIG. 2 illustrates an exploded view of a wheel assembly 4, according to an embodiment of the present disclosure. Wheel assembly 4 includes a wheel 24, an axle 22, an axle bracket 21 and a biasing mechanism 30. Axle 22 is received by a receptacle in the axle bracket 21, so as to allow the axle 22 to move back and forth in the receptacle relative to the bracket 21. Axle 22 is held in position in track 6 during operation of the dock door 1 by any suitable means, such as a pin 28 and biasing mechanism 30. Biasing mechanism 30 may be, for example, a spring or other tensioning member. In this manner, the wheel 24 is biased in position so as to ride in the track 6, as illustrated in FIG. 3A. The biasing mechanism is configured to also allow the wheel 24 and axle 22 to move relative to the bracket 21, so that the wheel 24 can be positioned out of the track 6, as shown in FIG. 3B.

Wheel bearings 23, washers 25 and 26, bolt 27 and lock ring 29 illustrate an example of an inner wheel assembly. Any other suitable inner wheel assembly can be employed.

Referring again to FIG. 1, a plurality of the wheel assemblies 4 can be attached to one or both sides of dock door 1. The wheel assemblies 4 can be attached to the door using any suitable means, such as brackets 2 and 3.

Track 6 of dock door system 100 includes at least one sidewall having angle, θ, relative to a rotational axis 32 of wheel 24, as more clearly shown in FIG. 3A. In an embodiment, the angle θ, can also be taken as relative to a line, L, normal to a side 34 of the track positioned between the two sidewalls, as shown in FIG. 3B. The one or more sidewalls of track 6 are angled in a manner that allows wheel 24 of wheel assembly 4 to move up the angled sidewall and out of the track 6 when a sufficient force is exerted on the dock door 1 to compress the biasing mechanism 30. For example, θ can range from about 10° to about 70°, such as about 30° to about 60°, or about 40° to about 50°.

In an embodiment, both sidewalls of track 6 can have an angle, θ. In an embodiment, an angled track 6 can be positioned on both sides of dock door 1, where one or both of the track sidewalls are angled. The systems of the present disclosure can offer impact protection on one side and not on the other side, both sides, or in differing amounts for each side of the door based on the angle, θ, that is used for each track. In addition, systems are contemplated that provide protection from impacts on either the inside or outside of the door or both, based on which sidewalls of each track are angled. For example, FIG. 1 shows an inside view of the dock door 1, with the tracks 6 configured so that the sidewalls closest to the outside are angled to provide protection from impacts occurring from inside the building on which the door is hung.

Dock door 1 can be any suitable type of overhead door. In an embodiment, dock door 1 is a rigid insulated door that is designed to maintain a substantially planar shape, similar to that shown in FIG. 1, as it is opened and closed. In an alternative embodiment, dock door 1 can be a roll-up style door. An example of such a door is described in U.S. patent application Ser. No. 13/585,994, filed Aug. 15, 2012, the disclosure of which is hereby incorporated by reference in its entirety.

Dock door 1 can include one or more optional components. Examples of the one or more optional components include weather stripping 7 and/or any other type of seal, a lock 9, a window 10, and a pull-down strap and/or handle 12, or other hardware. Any suitable type of automatic or manual door opening system can be employed to open and close the dock door 1. Such door opening systems are well known in the art.

Figure 4:
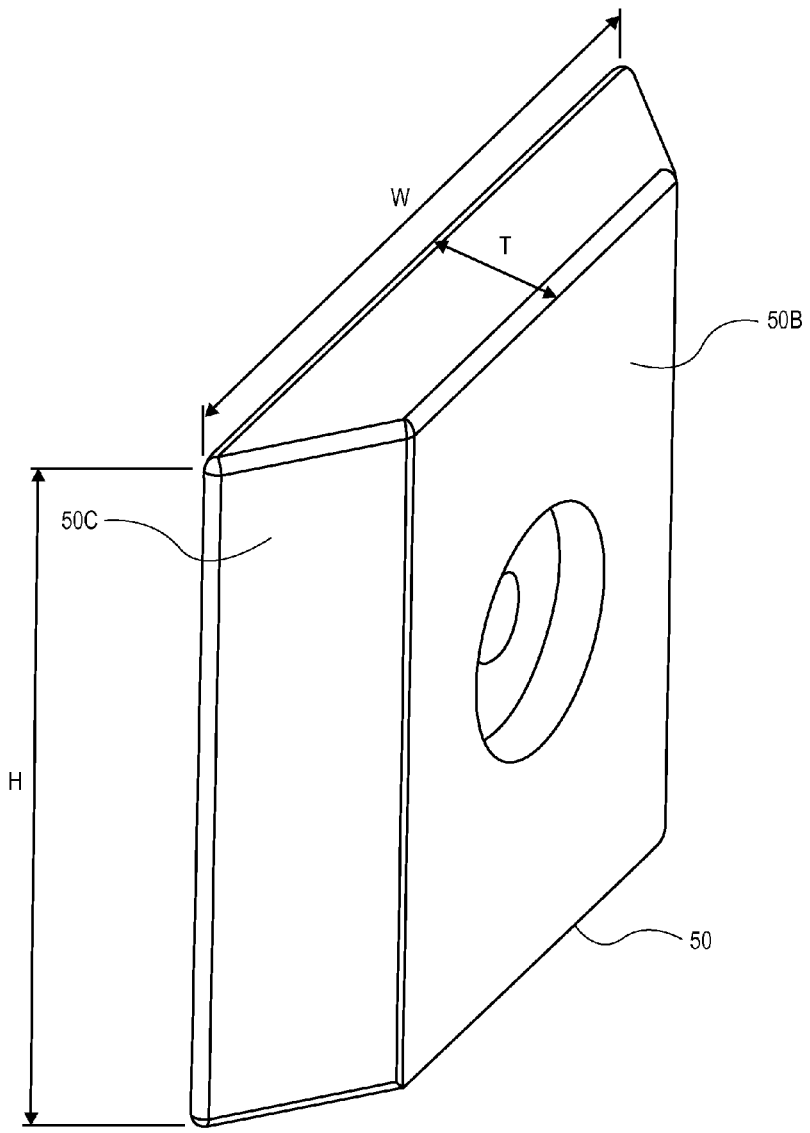
FIG. 4 illustrates a puck for guiding a dock door on a track, according to an embodiment of the present disclosure.
Figure 5:
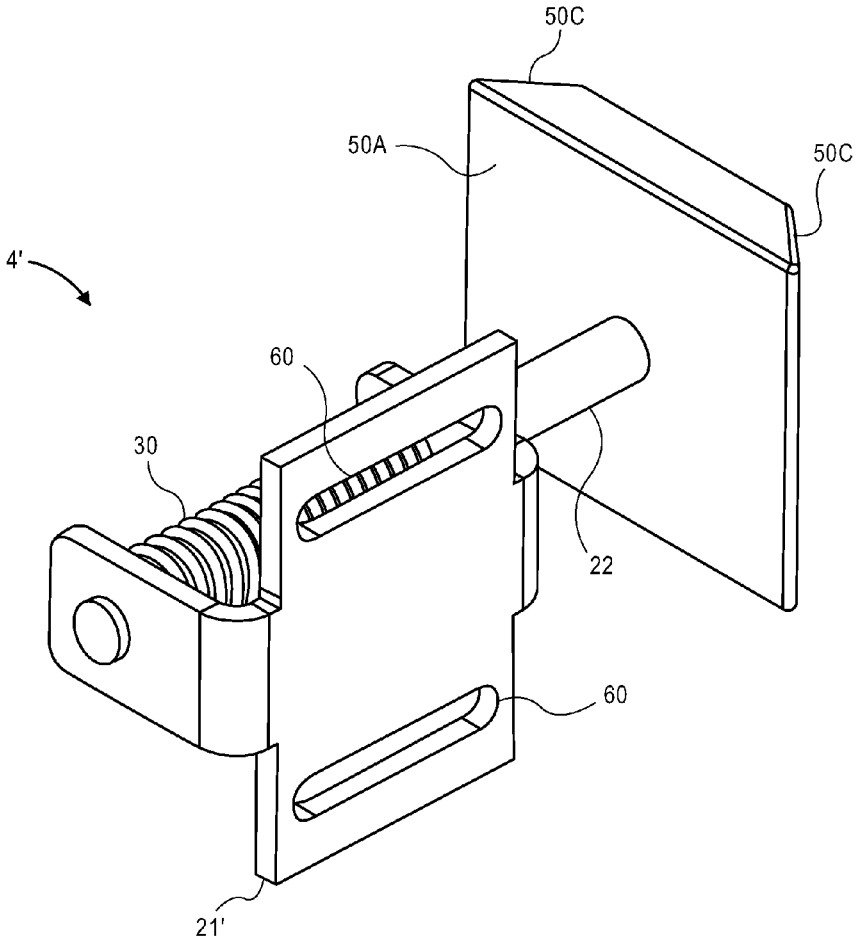
FIG. 5 illustrates a release assembly comprising a puck, according to an embodiment of the present disclosure.

In an embodiment of the present disclosure, a plurality of release assemblies 4', each comprising a puck 50, as shown in FIGS. 4 and 5, can be employed on a dock door 1 instead of the wheel-and-axle mechanisms described above. The plurality of release assemblies 4' comprising puck 50 can be attached to either or both sides of the dock door so as to allow the dock door to open and close on tracks 6.

Figure 6:
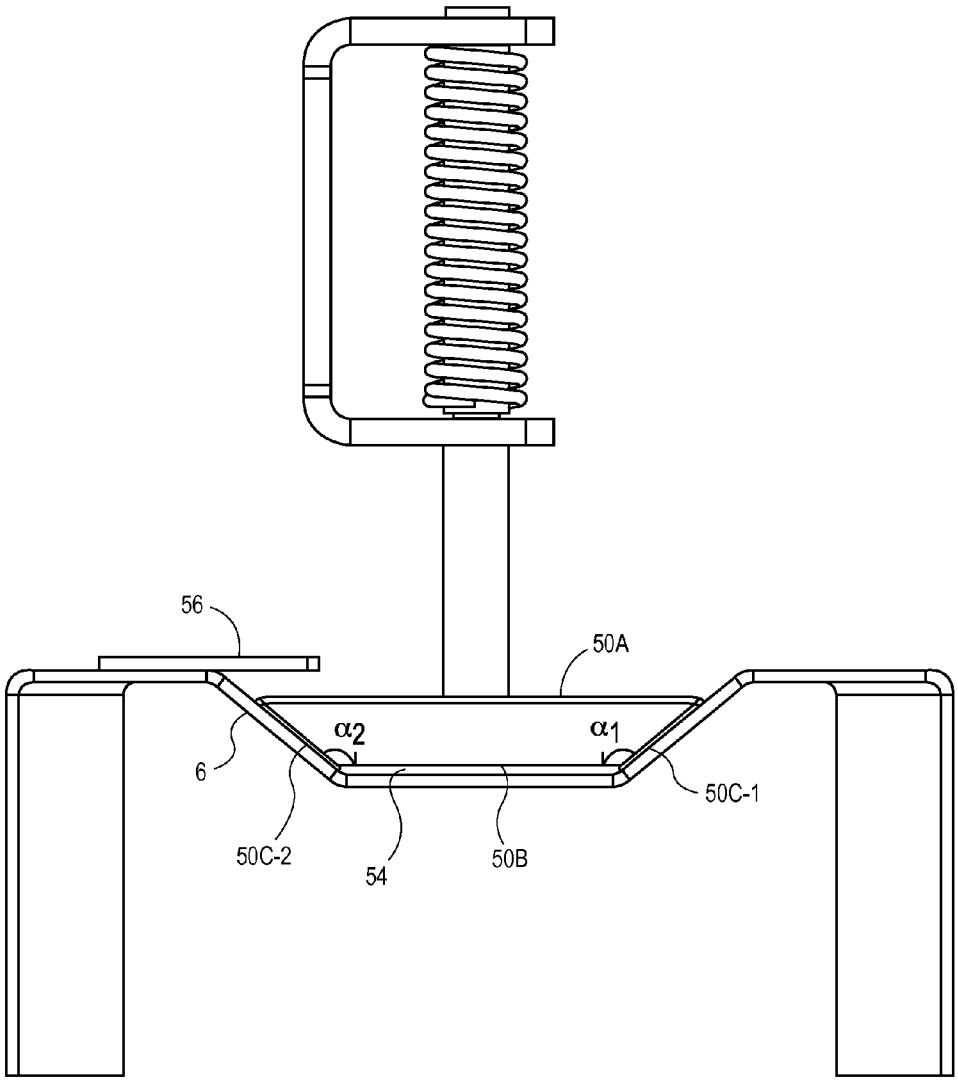
FIG. 6 illustrates a bi-directional release assembly with a puck positioned in a groove of a track, including an overhead view of the puck and track, according to an embodiment of the present disclosure.

Each release assembly 4' comprises, among other things, a biasing mechanism 30 for positioning the puck 50 so as to ride in the track 6, as shown in FIG. 6. Release assembly 4' is configured to allow the puck 50 to move toward the dock door and out of track 6, thereby releasing it from the track in the event that the door is struck with sufficient force in a direction that pushes the puck against an angled sidewall of the track. Any suitable release assembly capable of biasing the puck can be employed. For example, release assembly 4' can include a spring loaded bracket 21' and an axle 22. Axle 22 can be attached to puck 50 in any suitable manner. In an alternative embodiment, the assembly described herein and shown in FIG. 2 can also be employed with the puck 50 in place of the wheel 24, where the same or a different inner wheel assembly can be used with the puck 50.

In an embodiment as shown in FIG. 6, puck 50 can have a first major surface or base 50A, a second major surface or base 50B, and one or more beveled edges 50C extending from the first major surface 50A to the second major surface 50B. The beveled edges 50C are configured to be proximate the sidewalls of track 6 when the puck 50 is positioned therein. For example, the sidewalls of track 6 can be ¼ inch or less, such as ⅛ or 1/16 or 1/32 inch or less from the corresponding sidewalls of the track. In an embodiment, the sidewalls of track 6 directly contact one or both of the sidewalls of the puck when positioned in the track. In an embodiment, the second base 50B is parallel with and shorter than the first base 50A. A cross section of puck 50 can have a trapezoidal shape, with a first leg 50C-1 of the trapezoid extending from the second base at a first leg angle, $\alpha_1$, and a second leg 50C 2 of the trapezoid extending from the second base at a second leg angle, $\alpha_2$.

Figure 7A:
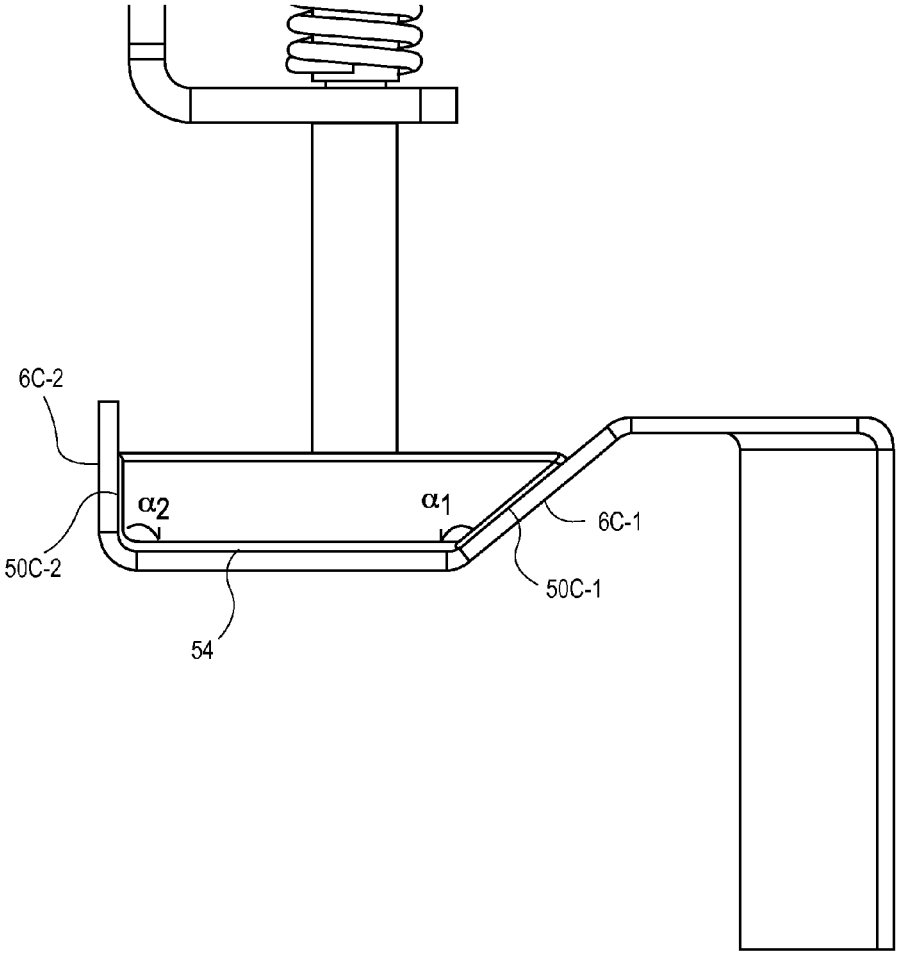
FIG. 7A illustrates a uni-directional release assembly positioned in a groove of a track, including an overhead view of the puck and track, according to an embodiment of the present disclosure.

Angles $\alpha_1$ and $\alpha_2$ can be the same or different and can be any suitable angle or angles that will provide the desired functionality. FIG. 6 illustrates an embodiment in which $\alpha_1$ and $\alpha_2$ are the same. FIG. 7 illustrates another embodiment in which $\alpha_1$ and $\alpha_2$ are different. Where both $\alpha_1$ and $\alpha_2$ are obtuse angles, as in FIG. 6, the puck 50 can function to provide bi-directional releasability, so that the dock door is capable of releasing from the track if struck from either side. Where one of $\alpha_1$ and $\alpha_2$ has about a 90° angle, such as $\alpha_2$ in FIG. 7A, the dock door is capable of uni-directional releasability, so that it is capable of releasing if struck from one side in a direction, for example, that pushes the puck against the beveled sidewall 6C-1 of track 6, but does not release if hit from the opposite side so as to push puck 50 against the non-beveled sidewall 6C-2.

In an embodiment, the shape of puck 50 allows it to slide up and down the track 6, as opposed to rolling down the track as does the wheel 24. However, the puck and axle 22 can be designed so that the puck 50 can pivot, or rotate, on the axle 22, so as to allow the puck to more easily follow the profile of a curved track while it slides up and down. Thus, axle 22 can have any suitable configuration, and/or puck 50 can be mounted on axle 22 using any suitable mechanism or in any suitable manner that will provide the desired movement of puck 50 as it traverses the track.

In addition to allowing bi-directional or uni-directional release of the puck from a track as discussed above, the chamfered design of puck 50 can aid in guiding a dock door back into the groove of a track after the door has been struck hard enough to cause it to release from the track. The beveled edge(s) in combination with the biasing mechanism effectively cause the puck to seek the lower energy potential position in the track after it has been knocked out of the track by a large force. With a wheel alone, a door that is knocked out of the track must generally be reset manually by pushing the door into place. With a puck, the door has the capability of resetting itself by simply cycling the door through a complete opening cycle. Thus, the puck shape can specifically act to guide the door back into its proper placement in the tracks after it has been hit with a force strong enough to displace the door from its position in the tracks.

The particular dimensions of the puck will vary depending on factors such as the dimensions of the track. For example, the puck width, "W", can be set to fit within the track profile, similarly as shown in FIG. 6 or FIG. 7A. Puck height, "H", can vary depending on, for example, the door requirements. In an embodiment, the puck width and height can be approximately the same, so that major surface 50A has the approximate shape of a square. In other embodiments, the width is greater than the height. In yet other embodiments, the height is greater than the width. In an embodiment, the thickness, "T", is less than either the height or the width. Example ratios of T:W and T:H include ranges of from about 1:3 to about 1:8, or 1:4 to about 1:6. Beveled edges are set to fit the track profile and can be angled based on the amount of force that is desired to allow a release of the puck out of the track profile.

In an embodiment where both edges of puck 50 are beveled, $\alpha_1$ and $\alpha_2$ can range from about 100° to about 160°, such as about 120° to about 150°, or about 130° to about 140°, or about 135°. In an embodiment where only first leg 50C-1 is beveled, $\alpha_1$ can be any of the angles mentioned above for $\alpha_1$, and $\alpha_2$ can be less than 100°, such as about 90°. For example, $\alpha_2$ can range from about 90° to about 160°. The puck shape, including the angles $\alpha_1$ and $\alpha_2$, can be designed to fit with a particular track profile.

Figure 7B:
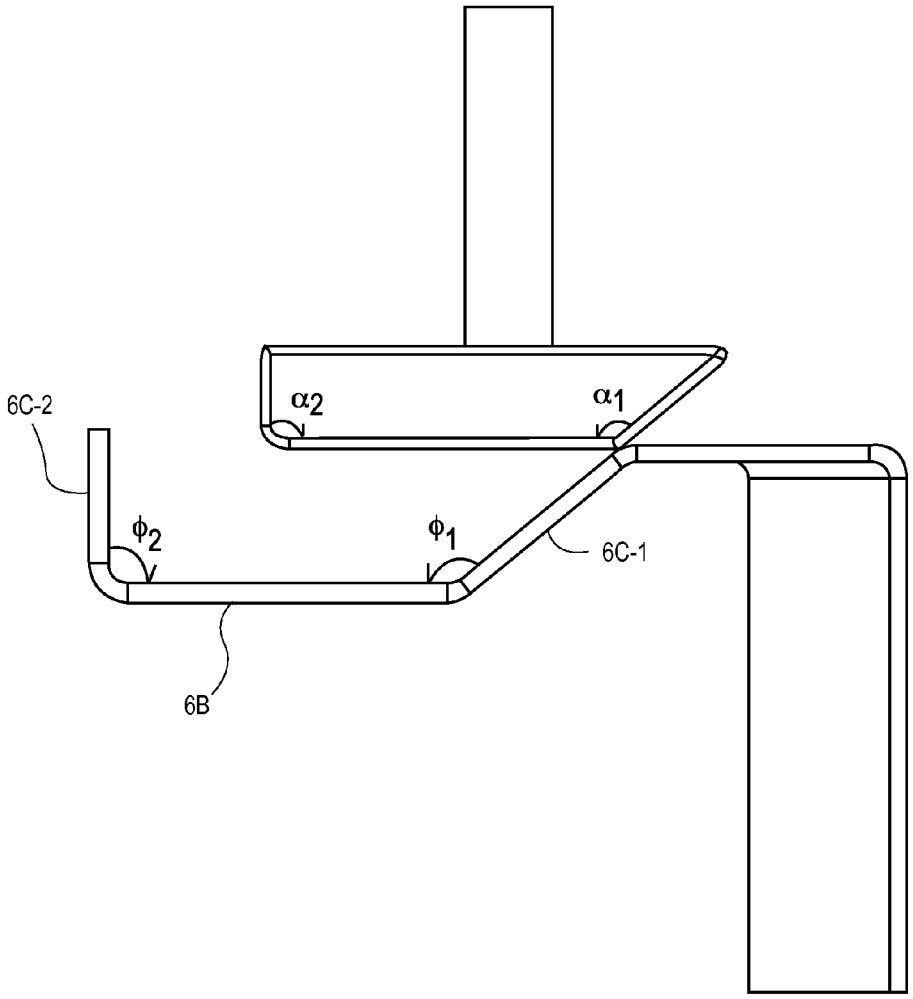
FIG. 7B illustrates the uni-directional release assembly of FIG. 7A coming out of the track, according to an embodiment of the present disclosure.

Referring to FIG. 7B, the track can have first angle, $\phi_1$, defined by the first and third substantially planar regions, and a second angle, $\phi_2$, defined by the second and third substantially planar regions. Angles $\phi_1$ and $\phi_2$ can be any of the track angles disclosed herein for track 6. In an embodiment, one or both of $\phi_1$ and $\phi_2$ can range from about 100° to about 160°, about 120° to about 150°, or about 130° to about 140°, or can be about 135°.

The angles $\alpha_1$ and $\alpha_2$ for the puck can be the same or different than the corresponding angles $\phi_1$ and $\phi_2$ for the track. In an embodiment, $\alpha_1$ for the puck is about the same as the corresponding angle, $\phi_1$, of the track between sidewall 6C-1 and a sidewall 6B, as shown in FIG. 7B, so that the beveled edge can fit substantially flush against the sidewall 6C-1. Similarly, $\alpha_2$ for the puck can be about the same as the corresponding angle, $\phi_2$, of the track between sidewall 6C-2 and sidewall 6B, so that the non-beveled edge (or beveled edge in the case where both edges are beveled) can fit substantially flush against the sidewall 6C-2. In an embodiment, a gap 54 exists between the puck 50 and the sidewall 6B when the puck is positioned into the first track so that both the legs 50C-1 and 50C-2 of puck 50 are flush against the sidewalls 6C-1 and 6C-2, respectively. In other embodiments, a gap 54 does not exist.

Puck 50 can be made of any suitable material, such as metals, polymeric materials, such as plastics or rubbers, and/or composite materials. If desired, the puck can be made or coated with a material that reduces friction between the track and the puck. One example of a suitable polymer that can be used for the puck is high density polyethylene ("HDPE"). HDPE is a relatively dense, self lubricating plastic that is relatively easy to tool to the desired shape. Examples of other suitable materials are well known in the art.

Figure 8:
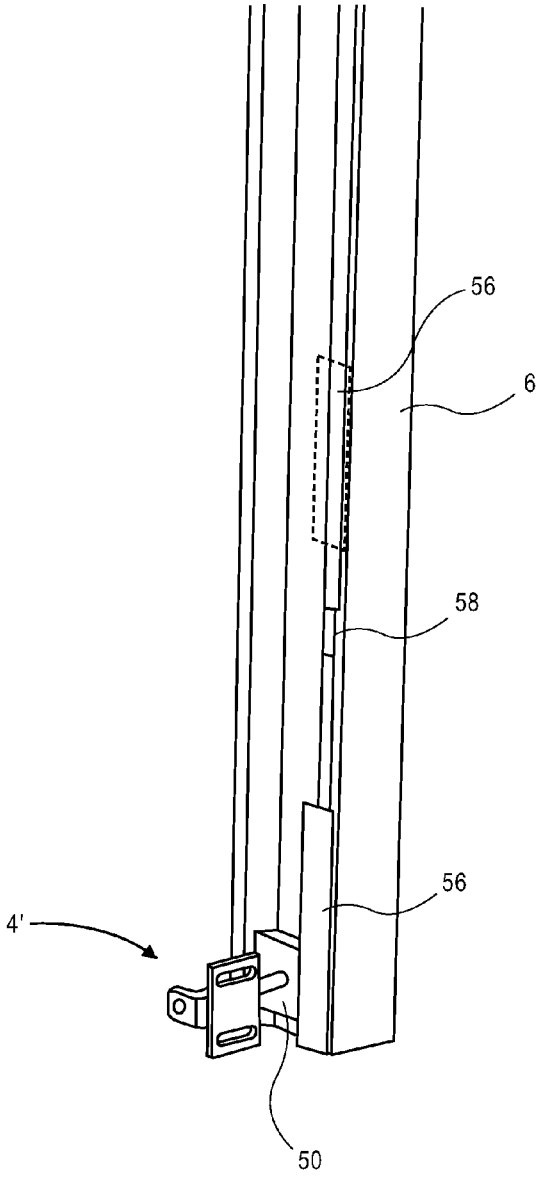
FIG. 8 illustrates the release assembly and track of FIG. 6 as it would be installed on a dock door opening, according to an embodiment of the present disclosure.

The puck shape can allow for the use of a stop bar 56, as shown in FIGS. 6 and 8. FIG. 6 illustrates a track 6 comprising an example stop bar 56 that extends over a sidewall of track 6 in a manner that prevents at least one of the pucks 50, such as a plurality of pucks 50, from moving out of the first track if the door is struck with a force in a direction that pushes the pucks against that sidewall when the door is fully closed. FIG. 8 illustrates stop bar 56 positioned proximate the bottom of the track, according to an embodiment of the disclosure. In this configuration, the dock door can break away from the tracks when the puck closest to the bottom edge of the dock door is positioned above the stop bar 56. Stop bar 56 can be any desired length that will stop at least one puck from coming out of the track 6. Examples of suitable stop bar lengths can be 4 or more inches, such as 6 to 24 inches or 8 to 12 inches.

Stop bar 56 can reduce the likelihood that the dock door will be knocked out of the tracks when it is in the fully closed position in the event that a sufficiently hard pressure is applied on one side of the dock door to displace it from its tracks. Thus, stop bar 56 allows the dock door to be a security door and/or to provide a desired level of hurricane proofing when the door is in the fully closed position. Once the door is in a position other than fully closed, the puck 50 in no longer blocked by the security bar and is now free to be displaced from the tracks if the door is hit while opening or closing. Because doors are often hit by forklifts when opening or closing, a door that acts as a breakaway door when in use, but as a non-breakaway door (e.g., security door) when closed, is a particularly attractive combination. If desired, one or more stop bar 56 can also be positioned at other positions, such as near the top of the door opening, or at positions between the top and bottom of the door opening, such as half way between the top and bottom, in order to further secure the door.

While only a single track is illustrate in FIG. 8, it is well known in the art that two tracks are employed, one on either side of each dock door. One or both tracks can have a beveled sidewall. In an embodiment, both tracks each have at least one beveled sidewall, such as two beveled sidewalls per track. One or more stop bars 56 can be positioned on only a single track (such as in the case where only that single track has beveled edges while the other track does not include a beveled edge). In an embodiment, one or more stop bars 56 can be positioned on both tracks of a dock door. Referring to FIG. 6, in addition to stop bar 56 a second stop bar (not shown) can be positioned over the other sidewall of the same track 6, thereby preventing the dock door from releasing from either side of the track.

Referring again to FIG. 8, track 6 can include a slot 58 to allow a dock door hasp (not shown) to secure the door in place. A slot 58 can be positioned on one or both tracks of a dock door. Examples of suitable dock door hasps are well known in the art.

The present disclosure is also directed to a method of installing a breakaway dock door system. The method can be employed for installing any of the dock door systems of the present disclosure. The method comprises installing a first track proximate a dock door opening. As disclosed herein, the first track comprises (i) a first sidewall comprising a first substantially planar region, (ii) a second sidewall comprising a second substantially planar region and (iii) a third sidewall comprising a third substantially planar region, the third sidewall being positioned between the first sidewall and the second sidewall. The first substantially planar region, the third substantially planar region and the second substantially planar region are consecutive planar regions. A first angle, $\phi_1$, is defined by the first and third substantially planar regions and a second angle, $\phi_2$, is defined by the second and third substantially planar regions. The first angle ranges from about 100° to about 160°. In an embodiment, a second corresponding track is installed on the dock door opening in addition to the first track.

A first plurality of release assemblies are installed on a side of a dock door. The first plurality of release assemblies are positioned on the door so as to be positionable in a first track. Each of the first plurality of release assemblies comprise a puck and a biasing mechanism, such as illustrated and described herein with respect to any of FIGS. 3A, 5 and 7A. Each of the first pucks are positioned by a respective one of the biasing mechanisms so as to ride in the first track when the door is installed on the track. The first plurality of release assemblies are configured to allow the first pucks to move toward the dock door and out of the first track if the door is struck with sufficient force in a direction that pushes the pucks against the first sidewall. In an embodiment, a second plurality of release assemblies are installed on a second side of the dock door in a manner similar to that describe above for the first plurality of release assemblies. The second plurality of release assemblies are positioned on the door so as to be positionable in a second track. Installation of the release assemblies and track can occur in any suitable manner using any desired mechanisms for attaching the release assemblies to the dock door and/or attaching the tracks proximate a dock door opening. Suitable attachment mechanisms are well known in the art. For example, release assemblies 4 can be bolted to the dock door through grooves 60 of bracket 21 shown in FIG. 5.

The dock door systems of the present disclosure can be installed on new dock doors and/or on new dock door openings. Alternatively, the systems can be installed on preexisting dock doors and door openings as a replacement of used dock door tracks and the corresponding wheels or other used hardware.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompasses by the following claims.

What is claimed is:

1. A dock door system comprising:

a first track and a second track, the first track comprising (i) a first sidewall comprising a first substantially planar region, (ii) a second sidewall comprising a second substantially planar region and (iii) a third sidewall comprising a third substantially planar region, the third sidewall being positioned between the first sidewall and the second sidewall, the first substantially planar region, the third substantially planar region and the second substantially planar region being consecutive planar regions, a first angle being defined by the first and third substantially planar regions and a second angle being defined by the second and third substantially planar regions, the first angle ranging from about 100° to about 160°; and a dock door comprising a first plurality of release assemblies and a second plurality of release assemblies, each of the first plurality of release assemblies comprising a puck and a biasing mechanism, each of the pucks biased by a respective one of the biasing mechanisms so as to ride in the first track, the first plurality of release assemblies being configured to allow the pucks to move toward the dock door and out of the first track if the door is struck with sufficient force in a direction that pushes the pucks against the first sidewall, wherein each of the pucks has a first major surface, a second major surface, a beveled edge extending from the first major surface to the second major surface and configured to be proximate to the first sidewall when the puck is positioned in the first track, and a second edge extending from the first major surface to the second major surface and configured to be proximate to the second sidewall when the puck is positioned in the first track.

2. The dock door system of claim 1, wherein each of the pucks has a trapezoidal cross section having a first base, a second base that is parallel with and shorter than the first base, a first leg extending from the second base at a first leg angle and a second leg extending from the second base at a second leg angle, wherein the first angles range from about 100° to about 160° and the second leg angles range from about 90° to about 160°.

3. The dock door system of claim 2, wherein the first leg angle is about the same as the first angle and the second leg angle is about the same as the second angle.

4. The dock door system of claim 2, wherein a gap exists between the pucks and the third sidewall when the pucks are positioned into the first track so that the beveled edges are flush against the first sidewall and the second edges are flush against the second sidewall.

5. The dock door system of claim 1, wherein the first angle ranges from about 120° to about 150°.

6. The dock door system of claim 1, wherein the second angle ranges from about 100° to about 160°.

7. The dock door system of claim 1, wherein the first track further comprises at least one stop bar that extends over the second sidewall in a manner that prevents at least one of the pucks from moving out of the first track if the door is struck with a force in a direction that pushes the pucks against the second sidewall when the door is fully closed.

8. The dock door system of claim 1, wherein the first track comprises a plurality of stop bars that extend over the second sidewall in a manner that prevents at least one of the pucks from moving out of the first track if the door is struck with a force in a direction that pushes the pucks against the second sidewall.

9. The dock door system of claim 1, wherein the biasing mechanisms are springs.

10. The dock door system of claim 1, wherein each of the first plurality of release assemblies further comprises an axle and an axle bracket having a receptacle for receiving the axle and which allows the axle to move back and forth in the receptacle relative to the bracket.

11. The dock door system of claim 10, wherein for each of the first plurality of release assemblies the axle can move in the receptacle between a first position wherein the puck is in the first track and a second position where the puck is out of the first track.

12. The dock door system of claim 1, wherein the second track is separate from the first track, the second track comprising (i) a fourth sidewall comprising a fourth substantially planar region, (ii) a fifth sidewall comprising a fifth substantially planar region and (iii) a sixth sidewall comprising a sixth substantially planar region, the sixth sidewall positioned between the fourth sidewall and the fifth sidewall, the fourth substantially planar region, the sixth substantially planar region and the fifth substantially planar region being consecutive planar regions, a third angle being defined by the fourth and sixth substantially planar regions and a fourth angle being defined by the fifth and sixth substantially planar regions, the third angle ranging from about 100° to about 160°.

13. The dock door system of claim 1, wherein the second track does not comprise a sidewall that allows pucks of the second plurality of release assemblies to move out of the second track.

14. A dock door hardware system comprising:

a track comprising (i) a first sidewall comprising a first substantially planar region, (ii) a second sidewall comprising a second substantially planar region and (iii) a third sidewall comprising a third substantially planar region, the third sidewall being positioned between the first sidewall and the second sidewall, the first substantially planar region, the third substantially planar region and the second substantially planar region being consecutive planar regions, a first angle being defined by the first and third substantially planar regions and a second angle being defined by the second and third substantially planar regions, the first angle ranging from about 100° to about 160°; and a release assembly comprising an axle, an axle bracket attachable to a dock door and having a receptacle for receiving the axle, a puck positioned on the axle, and a biasing mechanism configured for applying a force tending to force the puck away from the axle bracket and toward the track so as to ride in the track, the receptacle and the axle configured so as to allow the axle to move back and forth in the receptacle relative to the bracket, the release assembly being configured so that the puck can move out of the track if a sufficient force is applied to the release assembly in a direction that pushes the puck against the first sidewall, wherein the puck has a first major surface, a second major surface, a beveled edge extending from the first major surface to the second major surface and configured to be proximate to the first sidewall when the puck is positioned in the track, and a second edge extending from the first major surface to the second major surface and configured to be proximate to the second sidewall when the puck is positioned in the track.

15. The dock door hardware system of claim 14, wherein the puck has a trapezoidal cross section having a first base, a second base that is parallel with and shorter than the first base, a first leg extending from the second base at a first leg angle, and a second leg extending from the second base at a second leg angle, wherein the first leg angle ranges from about 100° to about 160° and the second leg angle ranges from about 90° to about 160°.

16. The dock door hardware system of claim 15, wherein the first leg angle is about the same as the first angle and the second leg angle is about the same as the second angle.

17. The dock door hardware system of claim 15, wherein a gap exists between the puck and the third sidewall when the puck is positioned in the track so that the beveled edge is flush against the first sidewall and the second edge is flush against the second sidewall.

18. The dock door hardware system of claim 15, wherein the track further comprises at least one stop bar that extends over the second sidewall in a manner that prevents the puck from moving out of the track if the release assembly is struck with a force in a direction that pushes the puck against the second sidewall.

19. A method of installing a breakaway dock door system, the method comprising:

installing a track proximate a dock door opening, the track comprising (i) a first sidewall comprising a first substantially planar region, (ii) a second sidewall comprising a second substantially planar region and (iii) a third sidewall comprising a third substantially planar region, the third sidewall being positioned between the first sidewall and the second sidewall, the first substantially planar region, the third substantially planar region and the second substantially planar region being consecutive planar regions, a first angle being defined by the first and third substantially planar regions and a second angle being defined by the second and third substantially planar regions, the first angle ranging from about 100° to about 160°; and installing a plurality of release assemblies on a side of a dock door, each of the plurality of release assemblies comprising a puck and a biasing mechanism, each of the pucks biased by a respective one of the biasing mechanisms so as to ride in the track, the plurality of release assemblies being configured to allow the pucks to move toward the dock door and out of the track if the door is struck with sufficient force in a direction that pushes the pucks against the first sidewall, wherein the each of the pucks has a first major surface, a second major surface, a beveled edge extending from the first major surface to the second major surface and configured to be proximate to the first sidewall when the puck is positioned in the track, and a second edge extending from the first major surface to the second major surface and configured to be proximate to the second sidewall when the puck is positioned in the track.

20. The method of claim 19, wherein the track further comprises at least one stop bar that extends over the second sidewall in a manner that prevents at least one of the pucks from moving out of the track if the door is struck with a force in a direction that pushes the pucks against the second sidewall when the door is fully closed.

* * * * *